United States Patent [19]

Sansone et al.

[11] Patent Number: 4,826,502

[45] Date of Patent: May 2, 1989

[54] SULFONATION OF HYDROXYETHYLATED POLYBENZIMIDAZOLE FIBERS

[75] Inventors: Michael J. Sansone, Berkeley Heights; Frank J. Onorato, Phillipsburg; Harry Pulaski, Elizabeth, all of N.J.

[73] Assignee: Hoechst Celanese Corp., Somerville, N.J.

[21] Appl. No.: 72,364

[22] Filed: Jul. 13, 1987

[51] Int. Cl.[4] ..... D06M 13/34; D06M 13/26

[52] U.S. Cl. ..... 8/115.59; 8/115.6; 8/115.56; 8/115.57; 8/115.65

[58] Field of Search ..... 525/433, 435, 363, 420; 526/259; 8/115.6, 115.51, 115.59, 115.56

[56] References Cited

U.S. PATENT DOCUMENTS 3,578,644 5/1971 Trischler ..... 526/259
4,599,388 7/1986 Bohrer et al. ..... 525/433

OTHER PUBLICATIONS

Abbot et al., "The Flammability, Thermal Stability and Dyeability Properties of High Temperature Organic Fibers", Technical Report AFML-TR-73-29, Feb. 1973.

Reinhart, K. A. et al., "PBI Dyeing and Color Stabilization", AD-775 356.

*Primary Examiner*—Paul Lieberman
*Assistant Examiner*—John F. McNally
*Attorney, Agent, or Firm*—Lynch, Cox, Gilman & Mahan

[57] ABSTRACT

A process for sulfonating preformed hydroxyethylated polybenzimidazole fibers is disclosed. The process comprises the steps of forming an hydroxyethylated polybenzimidazole spinning solution; spinning hydroxyethylated polybenzimidazole fibers, sulfonating the fibers by contacting them with a sulfonating agent, and heating the fiber in an inert atmosphere at a temperature and for a period of time sufficient to convert the ionic bonds, formed in the sulfonating step to covalent bonds, thereby, providing a covalently bonded, sulfonated, hydroxyethylated polybenzimidazole fiber. The fibers produced by the process of the present invention exhibit cation selectivity for electrodialysis and electrochemical applications.

35 Claims, No Drawings

SULFONATION OF HYDROXYETHYLATED POLYBENZIMIDAZOLE FIBERS

BACKGROUND OF THE INVENTION

1. Field of Invention

This invention relates to substituted polybenzimidazole articles and a process for their production. More particularly, the invention relates to the sulfonation of hydroxyethylated polybenzimidazole fibers and a process for their production.

2. Prior Art

Polybenzimidazoles are a known class of heterocyclic polymers which are characterized by a high degree of thermal and chemical stability. Processes for their production are disclosed in U.S. Re. 26,065, and U.S. Pat. Nos. 3,313,783, 3,509,108, 3,555,389, 3,433,772, 3,408,336, 3,549,603, 3,708,439, 4,154,919, and 4,312,976. (All patents enumerated herein are incorporated by reference.)

Shaped articles, such as fibers, produced from polybenzimidazole polymers can be quite useful for a broad range of applications, such as electrodialysis, reverse osmosis, and ultra filtration. However, because the pore size of these unsubstituted polybenzimidazole shaped articles is quite small, i.e. less than about one angstrom, the shaped articles cannot be used as filters for molecules having molecular weights greater than about 1000.

Further, although polybenzimidazole polymers are generally more resistant to chemical reaction than other types of polymers, such as cellulose acetate polymers, reaction at the imidazole nitro-hydrogen bond on the polybenzimidazole polymer will under certain conditions, thereby adversely affecting the performance of the polybenzimidazole polymer.

One method of reducing the reactivity of the polybenzimidazole polymer is by replacing the imidazole hydrogen with a less reactive substituent. Several processes for the production of such substituted polybenzimidazole polymers have been disclosed. For example, one process for producing the hydroxyethylated polybenzimidazole polymers used in this application is disclosed in U.S. Pat. No. 4,599,388. However, the '388 patent fails to disclose either a process for the sulfonation of hydroxyethylated polybenzimidazole polymers or a process for the production or sulfonation of hydroxyethylated polybenzimidazole fibers.

U.S. Pat. No. 3,578,644 also discloses a process for the production of hydroxyl-substituted polybenzimidazole polymers, by the reaction of a polybenzimidazole polymer with an omega-haloalkanol or a 1, 2 alkylene oxide in the presence of a basic catalyst. However, this reaction produces undesirable organic salts as a by-product and requires a pressurized vessel for the reaction. In addition, the types of polybenzimidazole polymers which can be used in the reaction are limited, because the bridging groups between the reactive imidazole rings of many polybenzimidazole polymers sterically hinder the reaction. As a result, polybenzimidazole polymers such as poly-2,2'(m-phenylene)-5,5'-bibenzimidazole and other similarly structured polybenzimidazole polymers, may not be used in this reaction Further, the '644 patent fails to disclose any process for the sulfonation of hydroxyethylated polybenzimidazole polymers or the production of hydroxyethylated polybenzimidazole fibers.

Additional processes for the production of substituted polybenzimidazole polymers or their products include: U.S. Pat. No. 4,579,915, wherein the imidazole hydrogen is replaced by an aromatic substituent corresponding to the formula:

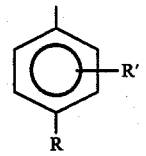

where R is nitro, cyano, or trifluoromethyl and R' is hydrogen, alkyl, nitro, cyano or trifluoromethyl; U.S. Pat. No. 4,377,546 which discloses a phenol substituted polybenzimidazole polymer; U.S. Pat. No. 3,943,125 which discloses a vast array of substituted tetraamino heterocyclic compounds; and U.S. Pat. No. 3,518,234 which discloses N-aryl substituted polybenzimidazole polymers. However, none of these patents disclose hydroxyethylated polybenzimidazole polymers, a process for their production, a process for sulfonation of hydroxyethylated polybenzimidazole polymers or a process for the production of hydroxyethylated polybenzimidazole fibers.

Another method of reducing the reactivity of polybenzimidazole polymers is by chemically modifying unsubstituted polybenzimidazole polymers, as is disclosed in U.S. Pat. No. 4,020,142. Technical reports published by Celanese Research Company (AD-755356, dated January, 1974) and Fabric Research Laboratories (AFML-TR-73-29, dated December, 1971) disclose a process for sulfonating unsubstituted polybenzimidazole fibers in order to reduce their thermal shrinkage. However these processes are significantly different from that disclosed in the instant invention.

Of particular interest in the preparation of useful polybenzimidazole shaped articles have been processes for the production of polybenzimidazole fibers. Polybenzimidazole fibers are produced by two basic processes, dry spinning, which involves spinning a polybenzimidazole polymer solution through a spinneret into an evaporative environment and wet spinning. In wet spinning, the spinning solution is spun through a spinneret either directly into a coagulation bath, wet jet/wet spinning, or through an air gap into the coagulation bath, dry jet/wet spinning. Typical dry spinning processes are disclosed in U.S. Pat. Nos. 3,584,104 and 3,502,756, while typical wet spinning processes are disclosed in U.S. Pat. Nos. 4,512,894, 4,263,245, 3,851,025, 3,619,453, 3,526,693 and 3,441,640.

While the processes for the production of polybenzimidazole fibers and the fibers produced by those processes may vary considerably, based on such factors as the composition of the coagulating bath, the denier of the spun fiber, or the structure of the fiber, none of the prior art patents disclose a method for spinning fibers formed from substituted polybenzimidazole polymers, in general, or hydroxyethylated polybenzimidazole polymers, in particular.

Accordingly, it is an object of the present invention to disclose a process for the preparation of sulfonated, hydroxyethylated polybenzimidazole fibers.

It is a further object of this invention to disclose a process for the preparation of sulfonated, hydroxyethylated polybenzimidazole fibers which are covalently bonded.

It is a still further object of this invention to disclose a process for the preparation of sulfonated, hydroxyethylated polybenzimidazole fibers that exhibit high chemical and thermal stability.

It is an additional object of this invention to disclose sulfonated, hydroxyethylated polybenzimidazole fibers which exhibit cation selectivity for electrodialysis and other electrochemical applications.

These and other objects, as well as the scope, nature and utilization of the process and the products produced by that process will be apparent to those skilled in the art, from a review of the following detailed description and appended claims.

SUMMARY OF THE INVENTION

In accordance with the present invention, there is provided a sulfonated, hydroxyethylated polybenzimidazole fiber which is prepared by the following process:

a forming an hydroxyethylated polybenzimidazole polymer spinning solution;

b. spinning an hydroxyethylated polybenzimidazole fiber from the hydroxyethylated polybenzimidazole polymer spinning solution;

c. sulfonating the hydroxyethylated polybenzimidazole fiber by contacting it with a sulfonating agent to induce the formation of an ionically bonded, sulfonated, hydroxyethylated polybenzimidazole fiber; and d. heating the ionically bonded, sulfonated, hydroxyethylated polybenzimidazole fiber in an inert atmosphere to convert the ionic bonds to covalent bonds, thereby producing a covalently bonded, sulfonated, hydroxyethylated polybenzimidazole fiber.

DETAILED DESCRIPTION OF INVENTION

A. The Starting Material

The polybenzimidazole starting materials are a known class of heterocyclic polymers which are characterized by a recurring monomeric unit which corresponds to the following Formulas I or II. Formula I is:

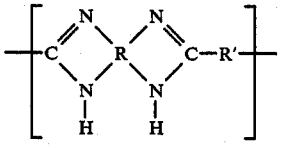

wherein R is a tetravalent aromatic nucleus with the nitrogen atoms forming the benzimidazole rings being paired upon adjacent carbon atoms, i.e., ortho carbon atoms, of the aromatic nucleus, and R′ is a divalent substituent selected from aliphatic, alicyclic and aromatic radicals. Illustrative of R′ substituents are divalent organic radicals containing between about 2 to about 20 carbon atoms, such as ethylene, propylene, butylene, cyclohexylene, phenylene, pyridine, pyrazine, furan, thiophene, pyran, and the like.

Formula II corresponds to the structure:

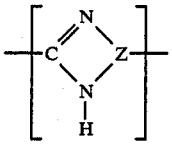

where Z is an aromatic nucleus having the nitrogen atoms forming the benzimidazole ring paired upon adjacent carbon atoms of the aromatic nucleus.

The above illustrated polybenzimidazoles can be prepare by various known processes, as described in the Background of Invention section.

The following generalized equation illustrates the condensation reaction which occurs in forming the polybenzimidazoles having the recurring units of Formula I:

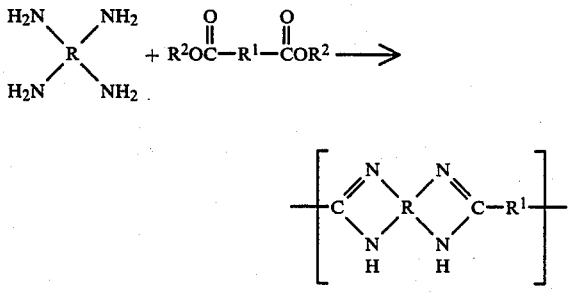

Such polybenzimidazoles are produced by the reaction of a mixture of (1) at least one aromatic tetraamine containing two groups of amine substituents, the amine substituents in each group being in an ortho position relative to each other, and (2) at least one dicarboxylate ester in which $R^1$ and $R^2$ in the compounds shown are substituents selected from aliphatic, alicyclic and aromatic groups.

Examples of polybenzimidazoles which have the recurring structure of Formula I include:

poly-2,2′-(m-phenylene)-5,5′-bibenzimidazole;
poly-2,2′-(pyridylene-3″, 5″)-5,5′-bibenzimidazole;
poly-2,2′-(furylene-2″, 5″)-5,5′-bibenzimidazole;
poly-2,2′-(naphthalene-1″, 6″)-5,5′-bibenzimidazole;
poly-2,2′-(biphenylene-4″, 4″)-5,5′-bibenzimidazole;
poly-2,2′-amylene-5,5′-bibenzimidazole;
poly-2,2′-octamethylene-5,5′-bibenzimidazole;
poly-2,6′-(m-phenylene)-diimidazobenzene;
poly-2,2′-(m-phenylene)-5,5′-di(benzimidazole)ether;
poly-2,2′-(m-phenylene)-5,5′-di(benzimidazole)sulfide;
poly-2,2′-(m-phenylene)-5,5′-di(benzimidazole)sulfone;
poly-2,2′-(m-phenylene)-5,5′-di(benzimidazole)methane;
poly-2,2″-(m-phenylene)-5′, 5″-di(benzimidazole)-propane-2,2; and
poly-2,2′-(m-phenylene)-5′, 5″-di(benzimidazole)ethylene-1,2.

The preferred polybenzimidazole of Formula I is poly-2,2′-(m-phenylene)-5,5′-bibenzimidazole as characterized by the following recurring monomeric unit:

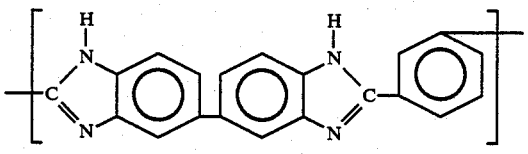

The polybenzimidazoles having the recurring monomer unit of Formula II can be prepared by the autocondensation of at least one aromatic compound having a pair of amine substituents in an ortho position relative to each other and a carboxylate ester group positioned upon an aromatic nucleus. Examples of such compounds are esters of diaminocarboxylic acids which include 3,4-diaminonaphthalene acid; 5,6-diaminonaphthalene-1-carboxylic acid; 5,6-diamino-naphthalene-2-carboxylic acid; 6,7-diaminonaphthalene-1-carboxylic acid; 6,7-diaminonaphthalene-2-carboxylic acid; and the like.

A polybenzimidazole starting material for the present invention process typically will exhibit an inherent viscosity between about 0.1–1.0 dl/g when measured at a concentration of 0.4 g of said polybenzimidazole in 100 ml of 97 percent sulfuric acid at 25° C.

The weight average molecular weight of a typical polybenzimidazole starting material will be in the range between about 1000–100,000.

B. The Carbonate Reaction

The above polybenzimidazole starting material is reacted with an ethylene carbonate in an organic solvent medium to produce the desired hydroxyethylated polybenzimidazole polymer.

The ethylene carbonate reactant can be employed essentially in any molar quantity with respect to the polybenzimidazole starting material to produce various percentages of substitution. Preferably, the ethylene carbonate reactant is employed in at least a stoichiometric quantity with respect to the reactive imidazole hydrogen sites on the polybenzimidazole polymer. In a preferred embodiment, the ratio of ethylene carbonate reactant groups to each reactive imidazole group is from about 2 to about 20 to 1. It is desirable to achieve at least about a 10 percent substitution of the reactive imidazole hydrogen sites with the hydroxyethyl group. In a preferred embodiment, substitutions of at least about 40 percent are obtained. The hydrophilicity of a hydroxyethylated polybenzimidazole product increases as the percentage of substitution increases.

The hydroxyethylation reaction between the ethylene carbonate and polybenzimidazole typically is conducted at a temperature between about 30° C. and about 225° C. for a reaction period between about 0.5 to about 24 hours. The reaction can be accomplished conveniently at ambient pressures. In a preferred embodiment the reaction occurs between about 145° C. and about 210° C. for a reaction period of about 3 to about 5 hours.

The concentration of the polybenzimidazole and ethylene carbonate reactants in the organic solvent reaction medium is limited only by the solubility of the polybenzimidazole in the solvent. Generally, the polybenzimidazole concentration in the organic solvent medium will be in the range from about 1 to about 35 percent by weight, based on the total weight of the reaction medium. The molecular weight of the polybenzimidazole is a factor in determining the maximum solute weight of the polymer in the organic solvent reaction medium. In a preferred embodiment polybenzimidazole dopes of about 15 to about 25 percent, by weight, are used.

Organic solvents suitable for purposes of the present invention include N,N-dimethylformamide, N,N-dimethylacetamide, dimethylsulfoxide, N-methyl-2-pyrrolidone, and the like, with N,N-dimethylacetamide and N-methyl-2-pyrrolidone the preferred solvents.

When unsubstituted ethylene carbonate is used as a reactant, the substituted polybenzimidazole produced is hydroxyethylated polybenzimidazole by the following reaction processes:

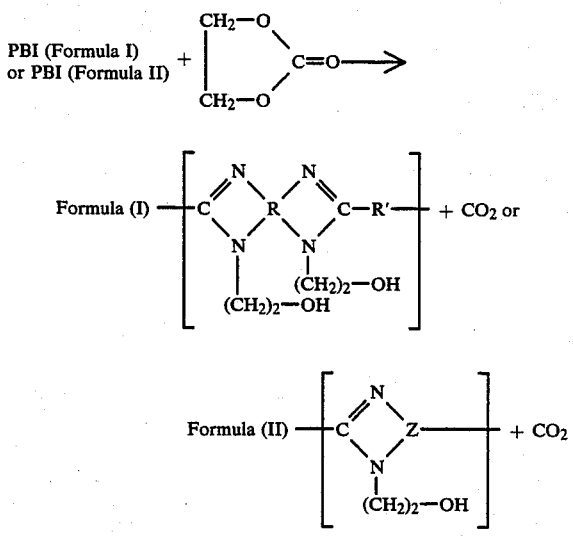

The (formula I) and (Formula II) repeating units correspond to the Formula I and Formula II structrures as previously defined.

After the reaction process is completed, the hydroxyethyl substituted polybenzimidazole can be recovered by any conventional procedures, such as by vacuum distillation of the solvent medium, to provide a residual polymeric solid, or by precipitation of the polymer from the solvent medium by addition of a non-solvent, such as methanol or hexane.

C. Fiber Formation

Using the hydroxyethylated polybenzimidazole polymer prepared by the preceding procedure, a spinning solution is prepared. Although the amount of hydroxyethylated polybenzimidazole polymer which can be used is dependent upon the viscosity and molecular weight of the particular hydroxyethylated polybenzimidazole polymer, polymer concentrations in the range of about 1 to about 30 percent, by weight, are typically used with polymer concentrations in the range of about 20 to about 30 percent by weight preferred. A minor amount of lithium chloride may also be added to prevent phase separation (ie. about 0.5 to about 5 percent by weight of the hydroxyethylated polybenzimidazole present in the solution). Suitable solvents for preparation of the spinning solution include those solvents which are commonly used in preparing the polybenzimidazole polymer starting solution including N,N-dimethylformamide, N,N-dimethylacetamide, dimethylsulfoxide, and N-methyl-2-pyrrolidone, with N,N-dimethylacetamide and N-methyl-2-pyrrolidone the preferred solvents.

The viscosity of the hydroxyethylated polybenzimidazole polymer can range from about 200 to about 2500 poises, because of the variations in percentage of substitution and molecular weight of the particular hydroxyethylated polybenzimidazole molecule. In selecting the hydroxyethylated polybenzimidazole dope to be used, it is desirable that the dope have the highest possible viscosity which can still easily be extruded under the desired extrusion conditions. In addition to variations in the fibers caused by different viscosities and percentages of solid content, the characteristics of both the spinning solution and the resulting spun fibers will also vary considerably depending on the percentage of substitution of the precursor hydroxyethylated polybenzimidazole polymer. Useful filaments are produced from hydroxyethylated polybenzimidazole polymers wherein the substitutions are greater than about 20 percent and preferably about 50 to about 70 percent.

Using conventional equipment and techniques, a spinning solution of the hydroxyethylated polybenzimidazole is placed in an extrusion or spinning bomb. The bomb, containing the spinning dope, is attached to a conventional spinneret and is pressurized with sufficient pressure to cause the polymer solution contained in the bomb to escape through the spinneret jet. It is, of course, understood that in order to prepare optimum fibers, the dope placed in the bomb should be filtered either prior to placing it in the bomb or just prior to spinning.

The hydroxyethylated polybenzimidazole polymer spinning solution is preferably introduced and maintained in the spinning bomb at about room temperature (i.e. from about 15° C. to about 35° C.) The spinning solution is extruded through a plurality of extrusion orifices (any reasonable number of orifices from about 5 or 10 to several 100 is acceptable). The orifices of the present invention can have a diameter of from about 20 to about 500 microns.

The fibers may be spun through conventional extrusion orifices to produce solid, non-hollow fibers or, in an alternative embodiment, the fibers spun may be hollow. The technique for spinning of such hollow fibers is well known.

Although wet spun hydroxyethylated polybenzimidazole fibers may be used to produce the sulfonated product, it has been discovered that wet spun hydroxyethylated polybenzimidazole fibers may be degraded by the subsequent sulfonating and heating process, and thus, the dry spinning process for producing hydroxyethylated polybenzimidazole fibers is preferred.

During the dry spinning operation, the hydroxyethylated polybenzimidazole solution may be extrded through a spinneret into a conventional down draft spinning column containing a circulating inert gas, such as nitrogen, noble gases, combustion gases or superheated steam, which serves as the evaporative medium. Conveniently, the spinneret face is at a temperature of from about 130° C. to 170° C., the top of the column from about 120° C. to 220° C., and the middle of the column from about 140° C. to 250° C. and the bottom of the column from about 160° C. to 320° C. The temperature within the column preferably progressively increases from the top to the bottom and the exact temperature range utilized is selected to exceed the boiling point of the specific hydroxyethylated polybenzimidazole solvent being employed as will be apparent to those skilled in the art.

The inert gas may be introduced under positive pressure at the top of the column and allowed to exit through an opening at the bottom of the column. If this system is used, the pressure of the inert gas should be sufficient to prevent any gases outside of the vessel from entering the column.

In a preferred embodiment, the inert gas is introduced into the column through a closed circulating system, whereby the inert gas enters the column at the top of the column, exits at the bottom of the column carrying with it any other gases contained within the column and enters a circulating and condensing system. Any non-inert gas vapors, such as those of the solvent for the hydroxyethylated polybenzimidazole spinning solution, are removed in this closed circulating and condensing system by conventional methods, such as condensation. The inert gas is then heated and reintroduced into the top of the column completing the circulating system.

Post Spinning Procedures

After leaving the spinning column, the continuous filamentary material is taken up on bobbins or wound about a system of skewed rolls at speeds ranging from about 50 to about 350 meters per minute. The continuous filamentary material is next washed while on the bobbins or on the system of skewed rolls. The resulting as-spun filamentary material may be subjected simultaneously to a slight steam drawing treatment at a draw ratio of about 1.05:1 to about 5:1 in order to prevent the fibers from relaxing and falling off the bobbin during the subsequent washing step.

Residual spinning solvent is removed from the continuous length of hydroxyethylated polybenzimidazole filamentary material so that the fibers contain less than about 1 percent by weight solvent based on the weight of the filamentary material, and preferably so as to obtain an essentially solvent-free material (i.e., fibers containing less than about 0.01 percent solvent by weight). Typically a simple water wash is employed; however, other wash materials, such as acetone, methanol, methylethyl ketone and similar solvent-miscible and volatile organic solvents, may be used in place of or in combination with water. The washing may be conducted by collecting the hydroxyethylated polybenzimidazole fibers on perforated rolls or bobbins, immersing the rolls in the liquid wash bath and pressure washing the fibers for example, for about 2 to about 48 hours or more. Alternatively, the continuous length of hydroxyethylated polybenzimidazole fibers may be washed on a continuous basis by passing the fibers through one or more liquid wash baths (e.g. for about 1 to about 10 minutes). As a further alternative, the fibers can be sprayed by a liquid, such as warm water, to remove the solvent. Any solvent removal techniques known to those skilled in the art may be selected.

The continuous length of hydroxyethylated polybenzimidazole fibrous material is next dried by any conventional technique to remove most of the residual water and/or moisture from the fibers. For instance, the bobbins of yarn may be dried by heating the fibers to a temperature of about 80° C. to 300° C. for about 2 to about 10 hours or more. Alternatively, the continuous length of hydroxyethylated polybenzimidazole fibers may be dried on a continuous basis by passing the fibers through a drying zone (e.g., an oven heated to about 300° C. to 400° C. for no more than about 1 minute). If temperatures or oven residence times in excess of these limits are employed, degradation of the fiber may occur.

Following the drying of the hydroxyethylated polybenzimidazole fibers, they may be drawn a second time by the application of longitudinal tension. Preferably the hydroxyethylated polybenzimidazole fibers are hot drawn at a ratio of about 1.2:1 to about 5:1 in order to enhance their orientation and strength.

If desired, the hydroxyethylated polybenzimidazole fibers may be annealed. The annealing process may increase the tightness of the fibers (i.e. decrease the size of the surface opening) and broaden the range of molecular weights that the fibers will filter. If the fibers are annealed, they may be annealed through any conventional annealing process for unsubstituted polybenzimidazole fibers as disclosed in U.S. Pat. No. 4,512,894, which is incorporated by reference.

E. The Chemical Modification

After the preformed hydroxyethylated polybenzimidazole fibers are collected, they are chemically modified to form covalently bonded, sulfonated, hydroxyethylated polybenzimidazole fibers. According to the process of the present invention, the preformed hydroxyethylated polybenzimidazole fibers are sulfonated by contacting the fibers with $SO_3$ or with any compound which releases $SO_3$. Suitable sulfonating agents include sulfonic acid, sulfuric acid complexes of $SO_3$ with a Lewis base or other organic compounds which release $SO_3$ ions.

Preferred Lewis bases from which the $SO_3$ complexes can be formed include pyridine, trimethylamine, dioxane, triethylamine, diethylaniline, thioxane, quinoline, dimethylformamide, triethylphosphate, and N-ethylmorpholine. Other Lewis bases include 2-methylpyridine, 2,6-dimethylpyridine, dimethylaniline, N-methylmorpholine, N-butylmorpholine, dimethylacetamide, tri-n-propylamine, tri-n-butylamine, triethylamine, and N,N-dimethylbenzylamine. Additional Lewis bases include tertiary amides, ethers, and thioethers.

Other organic compounds which release $SO_3$ complexes include pentamethylguanidine, poly(2-vinylpyridine), N-methylacetanilide, N,N-dimethyl-4-toluenesulfonamide, tetramethylurea, N,N-diemthylurethane, formylmorpholide, tetramethyladipamide, N,N-dimethylbenzamide, N-alkyl ethylene carbamates, dimethylcyanamide, trimethylphosphine oxide, diethyl ether, bis(2-chloroethyl)ether, diethyl sulfide, tetrahydrofuran, acetone, antraquinone, polycyclic mono-and diketones (benzanthrone, benzonaphthanoe, etc.), 2,6-dimethylpyrone, nitromethane, dimethyl sulfone, sulfolane, and dimethyl sulfoxide; acyl sulfates, such as acetyl sulfate, and the analogous compounds propionyl sulfate, butyl sulfate, 3-methylbutyl sulfate, and benzyl sulfate; alkyl sulfates, such as dimethyl sulfate; halosulfonic acids, such as chloro-, fluoro, and bromosulfonic acids, chlorosulfonic acid being preferred; sulfamic acid and organic sulfonic acids. The preferred sulfonating agent is sulfuric acid. As used herein, the term "sulfonating agent" also includes mixtures of the above-identified compounds and complexes.

The preformed hydroxyethylated polybenzimidazole fiber is contacted in a conventional bath with one of the sulfonating agents described above at a temperature within the range of approximately 5° C. to 100° C. The contacting temperature is preferably within the range of approximately 20° C. to 50° C., and is most preferably within the range of approximately 20° C. to 30° C.

The concentration of the sulfonating agent is not critical since much of it is flashed off in the subsequent heating step. When sulfuric acid is used as the sulfonating agent, concentrations of about 2 to about 30 percent or even higher can be used. The only limitation on the concentration is that the sulfonating agent not begin dissolution of the preformed hydroxyethylated polybenzimidazole fiber. When concentrations of sulfuric approach 75 percent, dissolution of the hydroxyethylated polybenzimidazole fibers may occur. Thus, preferred concentrations for the sulfonating agent should be about 5 to about 15 percent.

Because the preformed fiber readily undergoes sulfonation upon contact with the sulfonating agent, the contact time may be short. Preferably, the fiber is contacted with the sulfonating agent for a period of time within the range of approximately 30 seconds to about 5 minutes, and preferably, for about 2 to about 3 minutes. Although the sulfonation reaction is essentially instantaneous, the contact times given above ensure that the sulfonating agent penetrates to the interior of the fiber. When the fiber is sulfonated for the preferred sulfonation period, at least about 50 percent of the hydroxyethyl sites and imidazole sites are sulfated.

After the fiber has been contacted with the sulfonating agent, the fiber is then heated in an inert atmosphere in order to convert the ionic bonds, formed during the sulfonating step, to covalent bonds, thereby providing a covalently bonded, sulfnated, hydroxyethylated polybenzimidazole fiber. The inert atmosphere may be comprised of any of a number of non-oxidizing gases, such as nitrogen, argon, etc. or mixture thereof. The inert atmosphere is preferably nitrogen.

The temperature at which the sulfonated fiber is heated can be any temperature which is sufficient to convert the ionic bonds to covalent bonds. Preferably, the fiber is heated to a temperature of at least about 400° C., and, more preferably, at a temperature within the range of about 450° C. to about 510° C.

Likewise, the heating time can be any time which is sufficient, at the temperature employed, to convert the ionic bonds to covalent bonds. For example, at the preferred temperatures, a heating period of at least about 5 seconds is preferred. More preferably, the fiber is heated for approximately 8 to 30 seconds. When the fiber is heated at a sufficient temperature and time, conversion of at least about 50 percent of the ionic bonds to covalent bonds occurs.

Although the chemistry involed in the process of the present invention is not completely understood at present, it is believed that the sulfonation of the fiber using poly-2,2-(m-phenylene)-5,5'-bibenzimidazole resulting from the contacting step produces and amidine cation, as illustrated by equation (1) below:

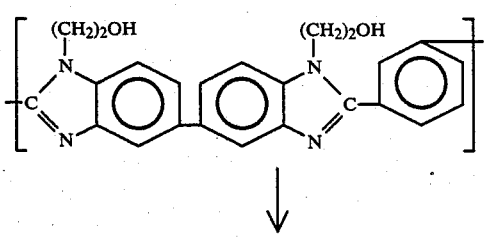

(1)

-continued

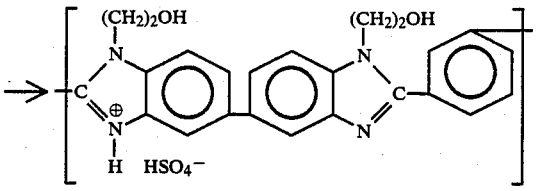

The heating of the sulfonated fiber is believed to result in the attachment of a sulfonate group to the aromatic ring, as illustrated by equation (2) below:

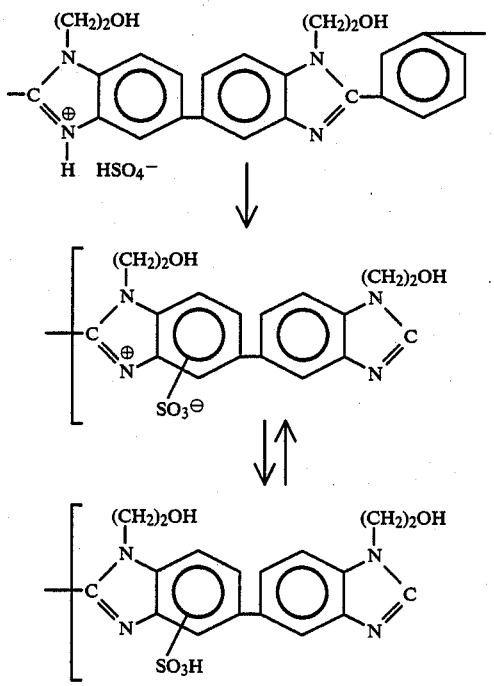

(2)

This proposed reaction sequence appears to explain the conversion during the heating step of the ionic bonds formed during the sulfonating step to covalent bonds, thereby providing a covalently bonded, sulfonated hydroxyethylated polybenzimidazole fiber.

The conversion of the ionic bonds of Equation (1) to the covalent bonds of Equation (2) can be confirmed by infrared spectroscopy. The existence of the ionic bonds of Equation (1) is indicated by absorptions which are characteristic of the amidine cation. The conversion to covalent bonds is indicated by absorptions which are characteristic of aryl sulfonic acid or sulfonate.

F. Uses for the Sulfonated Hydroxyethylated Polybenzimidazole Fibers

The covalently bonded, sulfonated, hydroxyethylated polybenzimidazole fiber produced in accordance with the process of the present invention exhibits improved separatory capabilities. For example, the sulfonated, hydroxyethylated polybenzimidazole fibers exhibit cation selectivity and are of particular utility in electrodialysis and other electrochemical applications. The hydroxyethylated polybenzimidazole fibers, which are chemically modified in accordance with the process of the present invention, also exhibit increased water flux for reverse osmosis purposes. The chemically modified hydroxyethylated polybenzimidazole fibers also exhibit increased resistance to fouling, and hence have longer lifetimes.

The separatory capabilities of the covalently bonded, sulfonated, hydroxyethylated polybenzimidazole fibers produced in accordance with the process of the present invention can be improved still further by a higher degrees of sulfonation which may be achieved by repeating the sulfonating/heating process of the present invention one or more times. However, for most purposes, a single sulfonating/heating sequence is sufficient to produce fibers exhibiting desirable separatory capabilities.

The following Examples are given as specific illustrations of the invention. All parts and percentages are by weight unless otherwise stated. It should be understood, however, that the invention is not limited to the specific details set forth in the Examples.

EXAMPLE 1

A polybenzimidazole starting solution was prepared by stirring 1000 grams of poly-2,2'-(m-phenylene)-5,5'-benzimidazole polymer in particulate form with 3545 grams of N,N-dimethylacetamide and 71 grams of lithium chloride for 6 hours under argon gas in a stirred autoclave at 240° C. The solution was then filtered to remove any residual solids. The contents were transferred to a three-neck, round bottom flask fitted with a reflux condenser, a mechanical stirrer, and a thermometer. 48 grams of 98 percent ethylene carbonate were added. The reaction flask was heated to 160° C. and held at that temperature for 15 hours. After the reaction, the solution was cooled to room temperature, and 8,000 grams of methanol were added to precipitate out the resulting solids, which were then air dried. Analysis disclosed the presence of 1,200 grams of hydroxyethylated polybenzimidazole, with a percentage of substitution of 70 percent.

EXAMPLE 2

500 grams of the 70 percent substituted hydroxyethylated polybenzimidazole particulate produced from the reaction of Example 1 were dissolved along with 36 grams of lithium chloride in 1820 grams of N,N-dimethylacetamide to form a spinning solution.

The solution after filtration to remove any undissolved particles, was placed in a spinning bomb, heated to a temperature of 65° C. and extruded through a spinneret having 40, 100 micron in diameter holes, positioned at the top of a conventional 20 foot down draft spinning column. Nitrogen gas heated to a temperature of 165° C. was allowed to flow through the column under a slight positive pressure. The spinning column was equipped with a closed circulating system. The nitrogen was introduced at the top of the column through the back of the spinneret and allowed to circulate throughout the column. At the bottom of the column an exit valve was produced through which the gases contained within the column exited the column. After exiting from the column, the gases entered a condenser which drew off any of the readily condensable vapors such dimethylacetamide. The nitrogen gas which remained was heated and returned to the line to be reintroduced into the column for recirculation.

The as-spun polybenzimidazole fibers were collected at the bottom of the column onto a take-up roller driven at a speed of 180 meters per minute. The resulting fibers were washed with methanol in a conventional wash bath for 3 minutes to remove the residual spinning solvent and dried in a conventional drying oven for 1 minute at a temperature of about 400° C.

EXAMPLE 3

The hydroxyethylated polybenzimidazole fibers prepared in Example 2 were immersed in 10 percent sulfuric acid at 50° C. for 5 minutes. The fiber was then rinsed in water and dried by heating to a temperature of about 100° C. for a period of about 5 minutes. The fiber was then placed into an oven at 450° C. for 30 seconds under nitrogen gas.

Examination of the fibers indicated that they had undergone sulfonation to the extent of 30 percent $SO_3$, which corresponds to 1.65 sulfonic acid groups per hydroxyethylated polybenzimidazole repeat unit. This indicates sulfonation is essentially complete.

As is apparent, the process of the instant invention produces dry spun, sulfonated hydroxyethylated polybenzimidazole fibers wherein the sulfonation it essentially complete. These fibers can be quite useful because of their high degree of substitution and sulfonation. In particular, the fibers can be useful because of their cation selectivity for electrodialysis and electrochemical applications.

We claim:

1. A process for sulfonating hydroxyethylated polybenzimidazole fibers comprising the steps of:

a. forming an hydroxyethylated polybenzimidazole polymer spinning solution;

b. spinning hydroxyethylated polybenzimidazole fibers from the hydroxyethylated polybenzimidazole spinning solution;

c. sulfonating the hydroxyethylated polybenzimidazole fibers by contacting the fibers with a sulfonating agent to induce the formation of ionically bonded, sulfonated hydroxyethylated polybenzimidazole fibers; and d. heating the ionically bonded, sulfonated, hydroxyethylated polybenzimidazole fibers in an inert atmosphere to a temperature of at least about 400° C. to convert the ionic bond to covalent bonds, thereby producing covalently bonded, sulfonated hydroxyethylated polybenzimidazole fibers.

2. The process of claim 1 wherein the sulfonating agent is selected from the group consisting of sulfuric acid, a complex of $SO_3$ with a Lewis base, acetyl sulfate, sulfamic acid, and mixtures of the foregoing.

3. The process of claim 1 wherein the sulfonating agent is sulfuric acid.

4. The process of claim 1 wherein the sulfonating agent is a complex of $SO_3$ with a Lewis base.

5. The process of claim 2 wherein the sulfonating agent is selected form the group consisting of pyridine, trimethylamine, dioxane, triethylamine, diethylaniline, thioxane, quinoline, dimethylformamide, triethylphosphate, and N-ethylmorpholine.

6. The process of claim 1 wherein the sulfonating agent is acetyl sulfate.

7. The process of claim 1 wherein the sulfonating agent is sulfamic acid.

8. The process of claim 1 wherein the sulfonating agent is a halosulfonic acid.

9. The process of claim 1 wherein the preformed hydroxyethylated polybenzimidazole fibers are contacted with the sulfonating agent at a temperature of approximately 5° C. to about 100° C. for about 30 seconds to about 5 minutes.

10. The process of claim 1 wherein the preformed hydroxyethylated polybenzimidazole fibers are contacted with the sulfonating agent at a temperature of approximately 20° C. to about 50° C. for about 2 minutes to about 3 minutes.

11. The process of claim 1 wherein the sulfonated hydroxyethylated polybenzimidazole fibers are heated at a temperature of about 450° C. to about 510° C.

12. The process of claim 1 wherein the sulfonated hydroxyethylated polybenzimidazole fibers are heated for a period of at least about 5 seconds.

13. The process of claim 1 wherein the sulfonated hydroxyethylated polybenzimidazole fibers are heated for a period of about 8 to about 30 seconds.

14. The covalently bonded, sulfonated, hydroxyethylated polybenzimidazole fibers produced by the process of claim 1.

15. A process for sulfonating hydroxyethylated polybenzimidazole fibers comprising the steps of:

a. forming an hydroxyethylated polybenzimidazole polymer spinning solution containing about 1 to about 25 percent by weight based on the total solution weight of the hydroxyethylated polybenzimidazole polymer;

b. dry spinning hydroxyethylated polybenzimidazole fibers from the hydroxyethylated polybenzimidazole polymer spinning solution;

c. sulfonating the hydroxyethylated polybenzimidazole fibers by contacting the fiber for about 30 seconds to about 5 minutes with a sulfonating agent maintained at a temperature of about 20° C. to 50° C., wherein the sulfonating agent is selected from the group consisting of sulfuric acid, a complex of $SO_3$ and a Lewis base, acetyl sulfate, sulfamic acid and mixtures of the foregoing to induce the formation of ionically bonded, sulfonated hydroxyethylated polybenzimidazole fibers; and d. heating the ionically bonded, sulfonated, hydroxyethylated polybenzimidazole fibers in a inert atmosphere at a temperature of at least about 400° C. for at least 5 seconds in order to convert the ionic bonds formed in the sulfonating step to covalent bonds, thereby producing covalently bonded, sulfonated, hydroxyethylated polybenzimidazole fibers.

16. The process of claim 15 wherein the fibers are contacted with the sulfonating agent at a temperature within the range of approximately 20° C. to 30° C.

17. The process of claim 15 wherein the sulfonating agent is sulfuric acid.

18. The process of claim 15 wherein the sulfonating agent is a complex of $SO_3$ with a Lewis base.

19. The process of claim wherein the Lewis base is selected from the group consisting of pyridine, trimethylamine, dioxane, triethylamine, diethylaniline, thioxane, quinoline, dimethylformamide, triethylphosphate, and N-ethylmorpholine.

20. The process of claim 18 wherein the sulfonating agent is acetyl sulfate.

21. The process of claim 15 wherein the sulfonating agent is sulfamic acid.

22. The process of claim 15 wherein the fibers are heated at a temperature within the range of about 450° C. to about 510° C.

23. The process of claim 15 wherein the fibers are heated for about 8 to about 30 seconds.

24. The covalently bonded, sulfonated, hydroxyethylated polybenzimidazole fibers produced by the process of claim 15.

25. A process for sulfonating hydroxyethylated polybenzimidazole fiber comprising the steps of:

a. forming an hydroxyethylated polybenzimidazole polymer solution containing about 20 to about 30 percent, by weight based on the total solution weight of the hydroxyethylated polybenzimidazole polymer;

b. dry spinning hydroxyethylated polybenzimidazole fibers from the hydroxyethylated polybenzimidazole polymer spinning solution;

c. Sulfonating the hydroxyethylated polybenzimidazole fibers by contacting the fiber for a period of about 2 minutes to about 3 minutes with sulfuric acid maintained at a temperature of about 20° C. to about 30°C. to induce the formation of ionically bonded, sulfonated hydroxyethylated polybenzimidazole fibers; and d. heating the ionically bonded, sulfonated, hydroxyethylated polybenzimidazole fibers in an inert atmosphere at a temperature of about 450° C. to about 510° C. for about 8 to about 30 seconds in order to convert the ionic bonds to covalent bonds, thereby producing covalently bonded, sulfonated, hydroxyethylated polybenzimidazole fibers.

26. The process of claim 25 wherein the sulfonating agent is a complex of $SO_3$ with a Lewis base.

27. The process of claim 26 wherein the Lewis base is selected from the group consisting of pyridine, trimethylamine, dioxane, triethylamine, diethylaniline, thioxane, quinoline, dimethylformamide, triethylphosphate, and N-ethylmorpholine.

28. The process of claim 25 wherein the sulfonating agent is acetyl sulfate.

29. The process of claim 25 wherein the sulfonating agent is sulfamic acid.

30. The process of claim 25 wherein the sulfonating agent is a sulfonic acid.

31. The covalently bonded, sulfonated, hydroxyethylated polybenzimidazole fibers produced by the process of claim 25.

32. The process as in any of claims 1, 15 or 25 wherein at least about 10 percent of the imidazole hydrogen sites are substituted with hydroxyethyl substituents.

33. The process as in any of claims 1, 15 or 25 wherein at least about 40 percent of the reactive imidazole hydrogen sites are substituted with hydroxyethyl substituents.

34. The process in claim 1 wherein the concentration of the hydroxyethylated polybenzimidazole polymer in the spinning solution is from about 10 to about 35 percent.

35. The process as in any of claims 1, 15 or 25 wherein the covalently bonded, sulfonated, hydroxyethylated polybenzimidazole fibers have a pore size from about 5 angstroms to about 100 angstroms.

* * * * *